United States Patent [19]

Escaron et al.

[11] 4,337,969

[45] Jul. 6, 1982

[54] EXTENSION MEMBER FOR WELL-LOGGING OPERATIONS

[75] Inventors: Pierre C. Escaron, Houston; Joachim A. Hoppe, Spring, both of Tex.

[73] Assignee: Schlumberger Technology Corp., Houston, Tex.

[21] Appl. No.: 194,010

[22] Filed: Oct. 6, 1980

[51] Int. Cl.[3] ..... F16L 57/00

[52] U.S. Cl. ..... 285/24; 285/119; 285/393; 285/45; 174/47; 174/136; 166/65 R

[58] Field of Search ..... 285/24, 119, 137 R, 285/45, 393; 138/103, 106, 108; 174/47, 136; 166/72, 242, 65 R

[56] References Cited

U.S. PATENT DOCUMENTS

| | | | |
|---|---|---|---|
| 2,829,190 | 4/1958 | Comlossy | 174/47 |
| 3,171,889 | 3/1965 | McCarthy | 174/47 X |
| 3,590,855 | 7/1961 | Woollen | 285/137 R |
| 3,740,861 | 6/1973 | Sears et al. | 285/137 R |
| 3,844,345 | 10/1974 | Evans et al. | 166/72 |
| 3,961,647 | 6/1976 | Doubleday | 174/47 |
| 4,068,966 | 1/1978 | Johnson | 174/47 |
| 4,082,144 | 4/1978 | Marquis | 166/242 |
| 4,103,936 | 8/1978 | Sutcliffe | 285/26 |

FOREIGN PATENT DOCUMENTS

| | | | |
|---|---|---|---|
| 560916 | 4/1957 | Italy | 174/47 |
| 323095 | 8/1957 | Switzerland | 174/47 |

*Primary Examiner*—David Arola

[57] ABSTRACT

A rigid extension member, for use with a well-logging cable in a borehole, has a means for protecting the well-logging cable disposed along the length of, and on the outer surface of, a cylindrical tube. Means for detachably securing the well-logging cable within the protection means is also provided.

3 Claims, 6 Drawing Figures

FIG.1
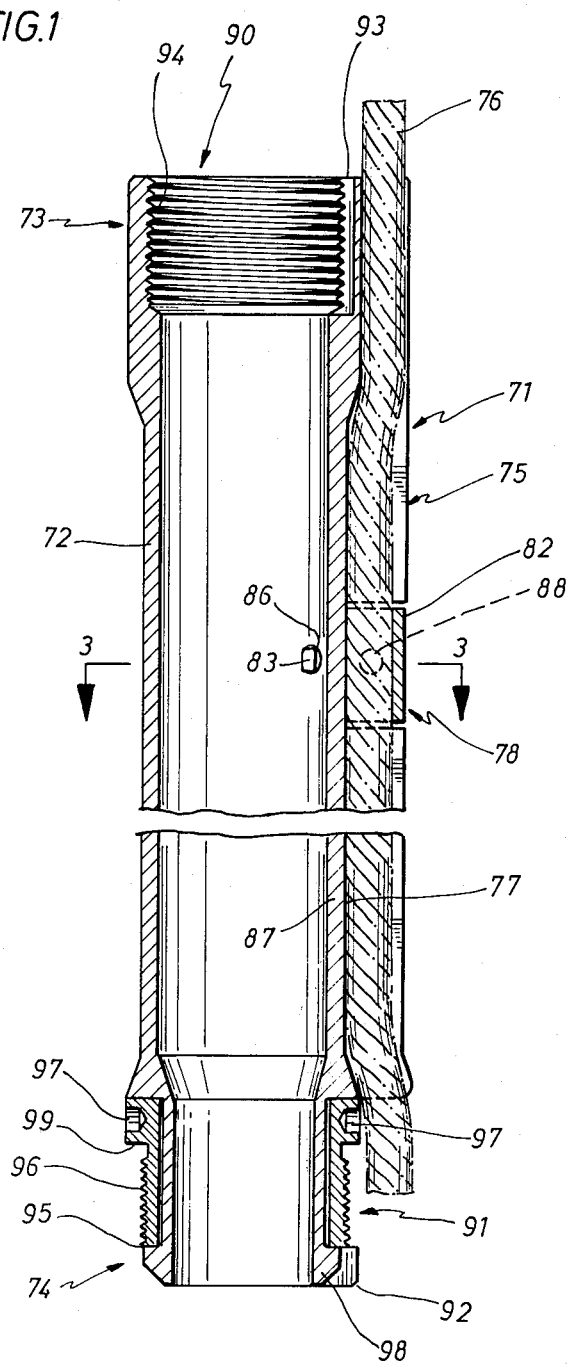
FIG.2
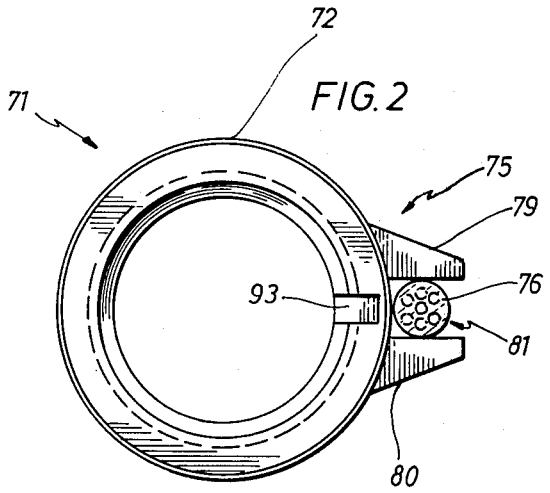
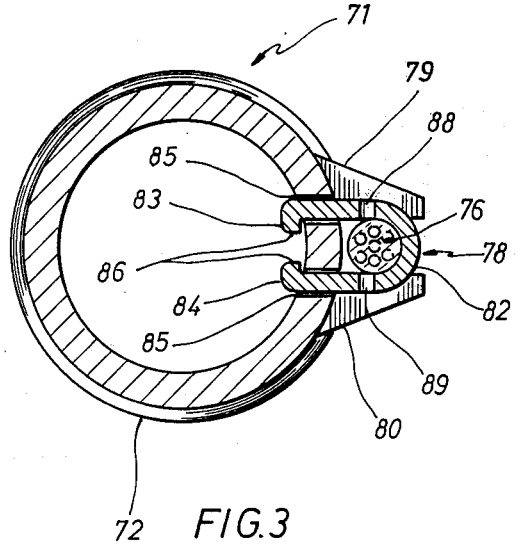
FIG.3

EXTENSION MEMBER FOR WELL-LOGGING OPERATIONS

FIELD OF THE INVENTION

The invention relates to an extension member for use with a well-logging cable in a borehole, particularly in deviated boreholes.

DESCRIPTION OF THE PRIOR ART

Many wells being drilled today in the search for oil and gas have portions of the borehole deviating from the usual vertical orientation thereof. Conditions, such as: shallow depth gas production; restrictions imposed by governmental agencies on the number of production platforms in certain areas; and exploration of reservoirs under shipping fairways, have resulted in boreholes including an increasing number of long, high deviation ramps, generally above 70° angles of deviation and lengths up to 16,000 feet.

Conventional well-logging instruments, used to determine various physical parameters of formations adjacent the borehole, cannot rely upon gravitational forces to enable such well-logging instruments to traverse the borehole while suspended from a well-logging cable in a highly deviated borehole. Thus, it has previously been proposed to move conventional well-logging instruments, or tools, through a borehole by use of an extension member affixed to the well-logging instrument, whereby the well-logging tool can be pushed or pulled through the borehole via the rigid extension member. Additionally, the well-logging cable is protected from physical damage incurred by contact with the walls of the borehole.

One example of such an extension member is disclosed in U.S. Pat. No. 4,082,144, issued to Marquis on Apr. 4, 1978. This patent discloses an extension member which has a longitudinal slot along its entire length to allow a wire-logging cable to be placed within the extension. A plurality of these extension members are connected in series via mating L-shaped extensions and female slots held in place by threaded split collars. The apparent disadvantages with this extension member are that each extension member requires precise machining operations to form the L-shaped extensions and female slots, as well as the longitudinal slot running the length of the extension member. Additionally, to avoid the excessive weight of such an extension member, additional manufacturing steps must be carried out to provide a lightweight collar disposed about the steel portion of such an extension member. The use of the collar to reduce the weight of the extension member thereby requires additional manufacturing steps to secure the collar to the extension member.

It has also been proposed to pass a well-logging cable through a plurality of extension members, or stingers, for use in well-logging operations in deviated boreholes; however, this approach has presented some problems. The assembly procedure is awkward, insofar as the cable must be passed through a plurality of tubular extensions and each extension member connected in turn to the previous extension member. Additionally, upon removal of the plurality of extension members, or stingers, from the borehole, the well-logging cable must be cut into short sections and discarded as the stingers are removed from the borehole and disassembled. Thus, this approach to allow well-logging operations in deviated holes is inefficient and uneconomical.

Accordingly, prior to the development of the present invention, there has been no extension member for use with well-logging cables in a borehole which is simple and economical to manufacture and is easily assembled and disassembled without damage to the well-logging cable. Therefore, the art has sought an extension member for use with well-logging cables in a borehole which is readily assembled and disassembled without damage to the well-logging cable and is economical to manufacture.

SUMMARY OF THE INVENTION

In accordance with the invention the foregoing has been achieved through the present extension member for use with a well-logging cable in a borehole. The present invention includes: a cylindrical tube having first and second ends; means for protecting a well-logging cable, said means being disposed along the length of, and on the outer surface of, said cylindrical tube; and means for detachably securing the well-logging cable within said means for protecting, whereby said well-logging cable is protected in said borehole and can be selectably removed from said tube without damage to the well-logging cable. A feature of the present invention resides in the fact that the means for protecting the well-logging cable comprises at least two rigid elongate members secured on the outer surface of said tube, which members form a generally U-shaped elongate channel for receiving the well-logging cable therein. The elongate channel may open outwardly away from the outer surface of the tube.

Another feature of the present invention is that the means for detachably securing the well-logging cable comprises at least one generally U-shaped clamp which releasably engages the tube, said at least one clamp being disposed intermediate the ends of the tube. Further, each of the ends of the tube includes means for connecting the tube to a tube of another extension member and the means for connecting also includes means for aligning the means for protecting of two adjacent extension members. The means for aligning may comprise a key member disposed at one end of the tube and a keyway disposed at the other end of the tube. A further feature of the invention resides in the fact that the means for connecting adjacent tubes includes a rotatably threaded ring disposed at one end of the tube, the ring having exterior threads, and an internally threaded socket disposed at the other end of the tube.

The extension member for use with a well-logging cable in a borehole of the present invention, when compared with previously proposed prior art extension members has the advantages of efficiency in assembly and disassembly and is economical to manufacture.

BRIEF DESCRIPTION OF THE DRAWINGS

In the drawings:

FIG. 1 is a cross-sectional view along the longitudinal axis of an extension member for use with a well-logging cable in a borehole in accordance with the present invention;

FIG. 2 is a top view of the extension member of the present invention;

FIG. 3 is a cross-sectional view of the extension member taken along line 3—3 of FIG. 1.

Figure 6:
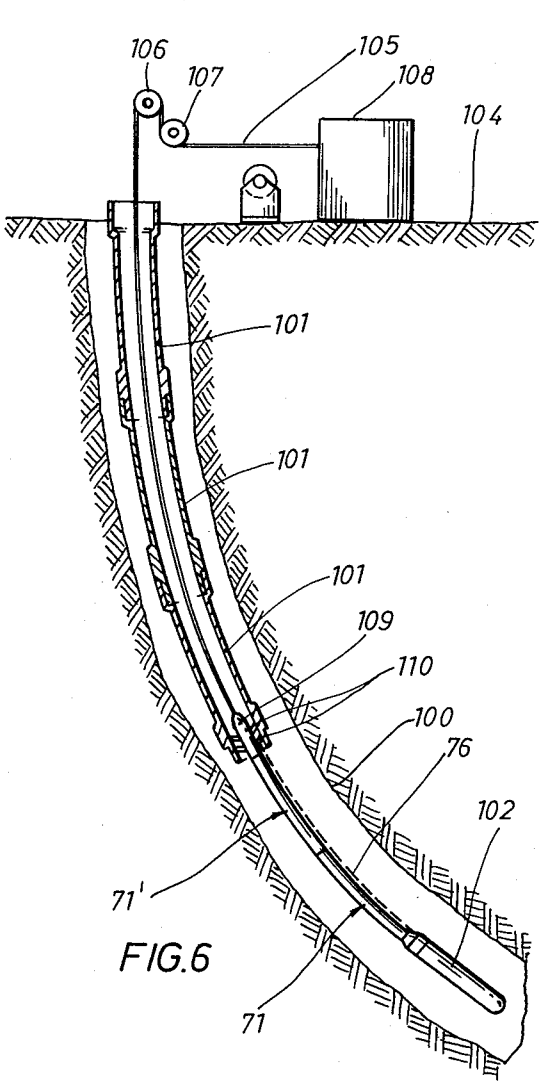
FIGS. 4–6 are schematic side views illustrating the use of the extension member of the present invention in a deviated borehole.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

In FIG. 1, a rigid extension member 71 in accordance with the present invention is shown to comprise a generally cylindrical tube 72 having first and second ends 73 and 74 and a means for protecting 75 a well-logging cable 76. Protection means 75 is disposed along the length of tube 72 and on the outer surface 77 of tube 72. Rigid extension member 71 also includes a means for detachably securing 78 the well-logging cable 76 within protection means 75.

The generally cylindrical tube 72 of extension member 71 may be made of any suitable material having the strength characteristics for supporting a well-logging instrument in a borehole, as well as the requisite durability characteristics necessary for equipment used in a borehole environment. Preferably, tube 72 is manufactured of steel.

With reference to FIGS. 1 and 2, it is seen that well-logging cable protection means 75 comprises at least two rigid elongate members 79 and 80 secured on the outer surface 77 of tube 72. Elongate members 79 and 80 form a generally U-shaped elongate channel 81 for receiving the well-logging cable 76 therein. Elongate channel 81 preferably opens outwardly away from the outer surface 77 of tube 72.

Preferably, elongate members 79 and 80 are manufactured of steel and are welded to the outer surface 77 of tube 72. Of course, any other suitable material having the necessary strength and durability characteristics could be utilized. Alternatively, well-logging cable protection means 75 could be a preformed U-shaped elongate channel member having two upwardly extending sides corresponding to elongated members 79 and 80 and a base member (not shown) forming the lower base portion of the elongate channel. The preformed elongate channel member could then be welded to the outer surface 77 of tube 72, whereby U-shaped elongate channel 81 would be formed as shown in FIG. 2.

With reference to FIGS. 1 and 3, it is seen that extension member 71 is provided with a means for detachably securing 78 the well-logging cable 76 within the elongate members 79 and 80 of well-logging cable protection means 75. Securing means 78 comprises at least one generally U-shaped clamp 82 which releasably engages tube 72 via the two depending legs 83 and 84 of clamp 82 which pass through two openings 85 formed in the outer surface 77 of tube 72. Depending legs 83 and 84 of clamp 82 may have inwardly facing wedge members 86 which engage the inner surface 87 of tube 72.

Although only one clamp 82 is shown in FIG. 1, of course more clamp members could be utilized along the length of tube 72, depending upon the total length of tube 72 of extension member 71. Preferably, at least one clamp 82 is disposed intermediate the ends 73 and 74 of tube 72 as shown in FIG. 1. Clamp 82 may include openings 88 and 89 therein for engagement with any suitable tool for applying the necessary force to remove clamp 82 from tube 72.

With reference to FIG. 1, it is seen that each of the ends 73 and 74 of tube 72 includes means for connecting tube 72 to another tube (not shown) of another extension member as will hereinafter be described in connection with FIGS. 4–6. Connection means 90 and 91 include a means for aligning protection means 75 of extension member 71 with a well-logging cable protection means of another adjacent extension member. With reference to FIGS. 1 and 2, it is seen that the alignment means for well-logging cable protection means 75 comprises a key member 92 disposed at end 74 of tube 72 and a mating keyway 93 disposed at the other end 73 of tube 72. As seen in FIG. 2, keyway 93 is preferably disposed adjacent well-logging cable protection means 75, and is formed parallel with, and intermediate, the longitudinal axis of elongate members 79 and 80. Of course, keyway 93 could be disposed in other positions so long as key member 92 and keyway 93 cooperate with one another to align protection means 75 of extension member 71 with well-logging cable protection means of another adjacent extension member.

Turning back to FIG. 1, connection means 90 and 91 will be described in greater detail. Connection means 90 of tube 72 is seen to include an internally threaded socket 94. Connection means 91 disposed at the lower end 74 of extension member 71 includes a rotatable ring 95 having threads 96 thereon. Threaded ring 95 may have a plurality of openings 97 formed therein at its upper end to enable a suitable tool to engage with holes 97 whereby rotatable threaded ring 95 may be rotated for connection with a threaded socket 94 of an adjacent extension member. It is also seen that key member 92 is disposed at the lower end 74 of tube 72 upon a flange member 98 which retains rotatable threaded ring 95 upon the lower end of extension member 71.

In order to connect a plurality of extension members 71 for use in a borehole, key member 92 is disposed within a keyway 93 of an adjacent extension member and the lower end 74 of extension member 71 is moved into threaded socket 94 until the threads 96 of rotatable threaded ring 95 engage the threads of the internally threaded socket member 94 of an adjacent extension member. Upon engagement of the threads, a rotational force is provided to rotatable ring 95, and rotatable threaded ring 95 is rotated inwardly into an adjacent socket member 94. As rotatable threaded ring 95 is rotated until an upper flange member 99 of ring 95 engages the top end 73 of an adjacent extension member, key member 92 slides downwardly within keyway 93 keeping the well-logging cable protection means 75 of adjacent extension members 71 aligned. Of course, it should be realized that extension member 71 could also be provided with a threaded ring having internally disposed threads for engagement with exterior threads formed on the upper end of an adjacent extension member.

Figure 5:
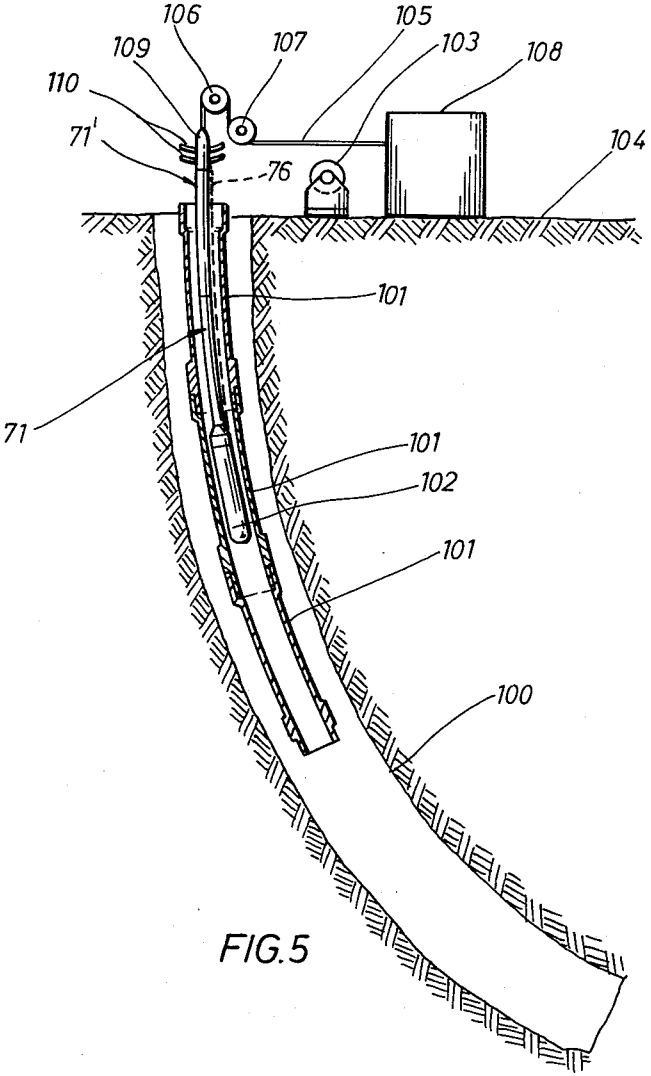
Figure 4:
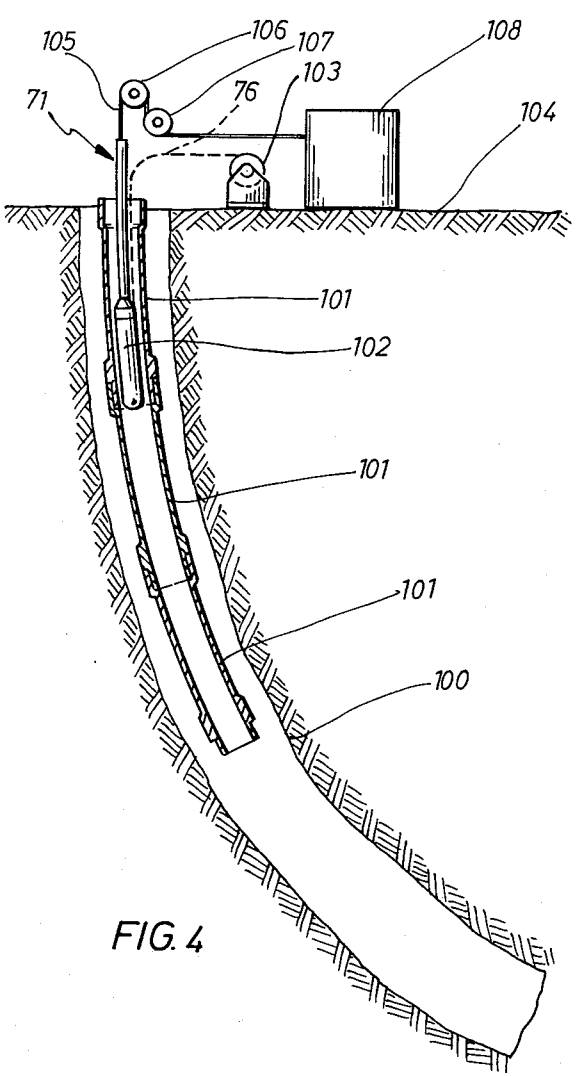

Turning now to FIGS. 4–6, the operation of extension member 71 in use with a well-logging cable in an earth borehole will be described. In FIGS. 4–6 a deviated borehole 100 is shown which has lengths of conventional open-ended drill pipe 101 run into the borehole 100 to a desired location where well-logging operations are to commence. With reference to FIG. 4, a conventional well-logging apparatus 102 is shown suspended within borehole 100. A first extension member 71 is connected to the top of well-logging apparatus 102 by any suitable connection. Well-logging cable 76 is mounted to the top of well-logging apparatus 102 and is placed within protection means 75, (FIG. 1) as well-logging apparatus 102 is lowered within drill pipe 101. As extension member 71 is lowered, the detachable securing means 78, or clamp 82, is positioned on extension member 71 to hold the well-logging cable 76 in place. Well-logging cable 76 is unreeled from reel 103 disposed at the surface 104. Cable 76 may advantageously have one or more conductors imbedded in a core and surrounded with material to make it conform to the geometry of elongate channel 81 (FIG. 2). Cable 76 is preferably of a length approximately the length of the stacked extension member 71, 71', . . . , but slightly longer to allow its connection to logging cable 76 via a conventional torpedo sub. Extension member 71, with well-logging apparatus 102 suspended beneath it, is held by a single or multi-conductor conventional well-logging cable 105 which passes over pulleys 106 and 107 and winds upon a surface winch (not shown) allowing the well-logging apparatus 102 to be moved along the drill pipe 101 in borehole 100. Conventional surface equipment 108 receives the measurement signals detected by means of sensors in the well-logging apparatus 102 as is well known in the art.

Turning to FIG. 5, it is seen that well-logging apparatus 102 and first extension member 71 have been lowered into the borehole 100 and another extension member 71' has been connected to the first extension member 71 in the manner as previously discussed in connection with FIGS. 1–3. After the desired number of extension members have been connected together, including detachably securing well-logging cable 76 along the length and on the outer surface of extension member 71 and 71'; logging cable 105 is detached from tool 71 and connected to well-logging cable 76 by means of a conventional torpedo sub 109. The signals from well-logging apparatus 102 can be transmitted through well-logging cable 76, torpedo sub 109, and cable 105, to the surface equipment 108. As is shown in FIG. 5, a conventional rubber cup locomotive 110 may be attached to torpedo sub 109.

Turning to FIG. 6, well-logging apparatus 102 and extension members 71 and 71' have moved downwardly through drill pipe 101 into borehole 100. Such movement is accomplished by pumping drilling mud (not shown) into drill pipe 101, and the pressure exerted by the drilling mud upon rubber cup locomotive 110 forces the well-logging apparatus and extension members 71 and 71' downwardly and into deviated borehole 100. A suitable means, such as a no-go plug and nipple (not shown) is provided to cooperate with torpedo sub 109 whereby torpedo sub 109 is precluded from exiting drill pipe 101. After torpedo sub 109 has reached the lower end of drill pipe 101, well-logging operations are commenced in the desired portion of deviated borehole 100. As well-logging cable 105 is winched upwardly, well-logging apparatus 102 and extension members 71 and 71' are moved upwardly through deviated borehole 100 and suitable signals are transmitted to surface equipment 108 via well-logging cable 76, torpedo sup 109, and cable 105. The entire time well-logging apparatus 102 is in drill pipe 101 or the open borehole 100, well-logging cable 76 is protected against mechanical damage by well-logging cable protection means 75.

To remove well-logging apparatus 102 and extension members 71 and 71' from the deviated borehole 100 and drill pipe 101, the process steps shown in FIGS. 4–6 are reversed. Thus, upon extension member 71' reaching the surface 104 as shown in FIG. 5, well-logging cable 76 is detached from the outer surface of extension member 71' by removing clamp 82 from tube 72 (FIGS. 1 and 3) and well-logging cable 76 is rewound upon reel 103. Accordingly, the entire length of well-logging cable 76 is quickly and easily detached from extension members 71 and 71', without the necessity of repeatedly cutting well-logging cable 76, so that it may be readily used for a subsequent well-logging operation.

It is to be understood that the invention is not limited to the exact details of construction, operation, exact materials or embodiment shown and described, as obvious modifications and equivalents will be apparent to one skilled in the art; for example, the means for protecting the well-logging cable could be a U-shaped channel member which clamps onto the outer surface of the extension member with the channel facing inwardly toward the outer surface of said tube. Accordingly, the invention is therefore to be limited only by the scope of the appended claims.

We claim:

1. A rigid extension member for use with a well-logging cable in a borehole, comprising:

a cylindrical tube having first and second ends;

means for protecting a well-logging cable, said means being disposed along substantially the entire length of, and on the outer surface of, said cylindrical tube and includes at least two rigid elongate members integrally secured on the outer surface of said tube, which members form a generally U-shaped elongate channel which opens outwardly away from the outer surface of said tube, for receiving the well-logging cable therein;

means for connecting each of said ends of the tube to a tube of another extension member, said means for connecting includes means for aligning said means for protecting with a means for protecting of another extension member; and means for detachably securing the well-logging cable within said means for protecting, and includes at least one generally U-shaped clamp which releasably engages the tube, said at least one clamp being disposed intermediate the ends of the tube, whereby the well-logging cable is protected in said borehole and can be selectively removed from said tube without damage to the well-logging cable.

2. The extension member of claim 1 wherein the means for aligning comprises a key member disposed at one end of the tube and a keyway disposed at the other end of the tube, whereby the key member of said tube cooperates with the keyway of another adjacent tube.

3. The extension member of claim 1 wherein the means for connecting includes a rotatable threaded ring disposed at one end of the tube, said ring having exterior threads, and an internally threaded socket disposed at the other end of said tube.

* * * * *